US005855487A

United States Patent [19]

Kunishi

[11] Patent Number: 5,855,487

[45] Date of Patent: Jan. 5, 1999

[54] SOCKET FOR FLUORESCENT LAMPS

[75] Inventor: Shinsuke Kunishi, Hadano, Japan

[73] Assignee: Molex Incorporated, Lisle, Ill.

[21] Appl. No.: 829,411

[22] Filed: Mar. 31, 1997

[30] Foreign Application Priority Data

May 10, 1996 [JP] Japan ..... 8-141093

[51] Int. Cl.[6] ..... H01R 33/02

[52] U.S. Cl. ..... 439/232

[58] Field of Search ..... 439/226–228, 439/230, 232, 233

[56] References Cited

U.S. PATENT DOCUMENTS

| | | | |
|---|---|---|---|
| 2,252,340 | 8/1941 | Bryant et al. | 439/232 |
| 3,892,457 | 7/1975 | Detch et al. | 439/233 |
| 3,942,858 | 3/1976 | Ouchi . | |
| 4,542,947 | 9/1985 | Flor et al. . | |
| 4,565,415 | 1/1986 | Feinberg . | |
| 4,637,671 | 1/1987 | Johnson et al. . | |
| 4,643,503 | 2/1987 | Johnson et al. . | |
| 5,169,331 | 12/1992 | Caldwell et al. | 439/232 |
| 5,376,025 | 12/1994 | Willnat et al. | 439/817 |

*Primary Examiner*—Gary F. Paumen
*Attorney, Agent, or Firm*—Stephen Z. Weiss

[57] ABSTRACT

A lamp socket is adapted for receiving a fluorescent lamp of the type which has a pair of parallel contact pins extending axially from opposite ends thereof. The lamp is adapted to be moved at a right angle to its longitudinal axis into the socket. A socket housing has a pair of generally parallel slots for receiving the contact pins as the pins are moved into the slots in a direction generally perpendicular to the axes of the pins. A pair of terminals are mounted in the socket housing respectively exposed in the slots for engagement by the contact pins. A lever is pivotally mounted on the socket housing and includes blocking portions aligned with the slots. The lever is pivotable between a first position wherein the blocking portions are removed from the slots to allow movement of the contact pins into the slots and a second position wherein the blocking portions block the slots to prevent movement of the contact pins out of the slots. The terminals include spring portions for biasing the lever toward its second position. The lever includes notches for receiving the contact pins in a preliminary position preparatory to moving the pins fully into the slots.

21 Claims, 14 Drawing Sheets

SOCKET FOR FLUORESCENT LAMPS

FIELD OF THE INVENTION

This invention generally relates to the art of electrical connections and, particularly, to an electrical socket for fluorescent lamps.

BACKGROUND OF THE INVENTION

A common lamp socket is designed for receiving the type of fluorescent lamp which has two axially extending bayonet contact pins at each end thereof. These pins are equally spaced from the axis of the lamp and lie on a diameter thereof. The most common type of fluorescent lamp with this construction is the rapid start fluorescent lamp which has a filament in each end and requires two end connections at opposite ends of the lamp.

Generally, there are two systems for mounting fluorescent lamps in the sockets of electrical fixtures. In one system, the lamp is moved longitudinally to insert the bayonet contact pins axially into holes or slots in the lamp sockets. In other words, the bayonet pins are inserted into the holes or slots in a direction parallel to the axes of the pins. A problem with such systems is that the fixtures must be excessively long to accommodate this axial movement. In fact, the lamp socket at one end of the fluorescent lamp in such systems often includes an extended, spring-loaded receptacle portion to accommodate axial movement of the lamp.

A second system is designed such that the fluorescent lamp is adapted to be moved at a right angle to the axis of the lamp to cause the bayonet contact pins at opposite ends of the lamp to enter grooves or channels formed in the lamp socket. The lamp then is twisted or rotated about its longitudinal axis to lock the lamp in the socket. A problem with this second system is that it is difficult to manually determine the amount of rotation required to fully seat and lock the lamp in position. Oftentimes excessive force is used to ensure that the lamp has been fully rotated and damage or breakage is caused with the pins, the socket terminals or other adjacent components. In other instances, a user may be overly cautious and fail to rotate the lamp sufficiently to establish a positive and reliable connection in the socket.

The present invention is directed to solving these problems in a lamp socket for fluorescent lamps which are adapted to be moved into the socket at a right angle to the longitudinal axis of the lamp.

SUMMARY OF THE INVENTION

An object, therefore, of the invention is to provide a new and improved lamp socket for fluorescent lamps of the type which has a pair of parallel contact pins extending axially from opposite ends thereof, the lamp being adapted to be moved at a right angle to its longitudinal axis into the socket.

In the exemplary embodiment of the invention, the lamp socket includes a housing having a pair of generally parallel slots for receiving the contact pins as the pins are moved into the slots in a direction generally perpendicular to the axes of the pins. A pair of terminals are mounted in the housing respectively exposed in the slots for engagement by the contact pins. A lever is pivotally mounted on the housing and includes blocking portions aligned with the slots. The lever is pivotable between a first position wherein the blocking portions are removed from the slots to allow movement of the contact pins into the slots and a second position wherein the blocking portions block the slots to prevent movement of the contact pins out of the slots. Spring means are provided for biasing the lever toward its second position.

As disclosed herein, the lever includes a guide rib movable within a guide groove in the housing centrally between the slots. The blocking portions are located on opposite sides of the guide rib. In the preferred embodiment, the lever includes a pair of wings on opposite sides of the guide rib, with the wings terminating in a pair of shoulders defining the blocking portions of the lever.

The spring means for biasing the lever toward its second position is provided herein by a resilient portion of at least one of the terminals. Each terminal includes side contact portions located on opposite sides of a respective one of the slots for engaging a respective one of the contact pins. A central resilient portion of each terminal is disposed between the side portions to form the spring means for biasing the lever.

Another feature of the invention is the provision of receiving means on the lever for receiving the contact pins in a preliminary position preparatory to moving the pins fully into the slots. This allows at least one end of the fluorescent lamp to be preliminarily positioned and held while manipulating the opposite end of the lamp, prior to fully inserting the lamp into the socket. The receiving means also prevents the fluorescent lamp from falling completely out of the socket in the event that the contact pins are momentarily moved out of engagement with the blocking portions of the lever. As disclosed herein, the receiving means is provided by notches in the wings of the lever forward of the blocking portions of the lever.

Finally, the wings may comprise ramps engageable by the contact pins to automatically bias the lever to its first position in response to movement of the contact pins into the slots.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
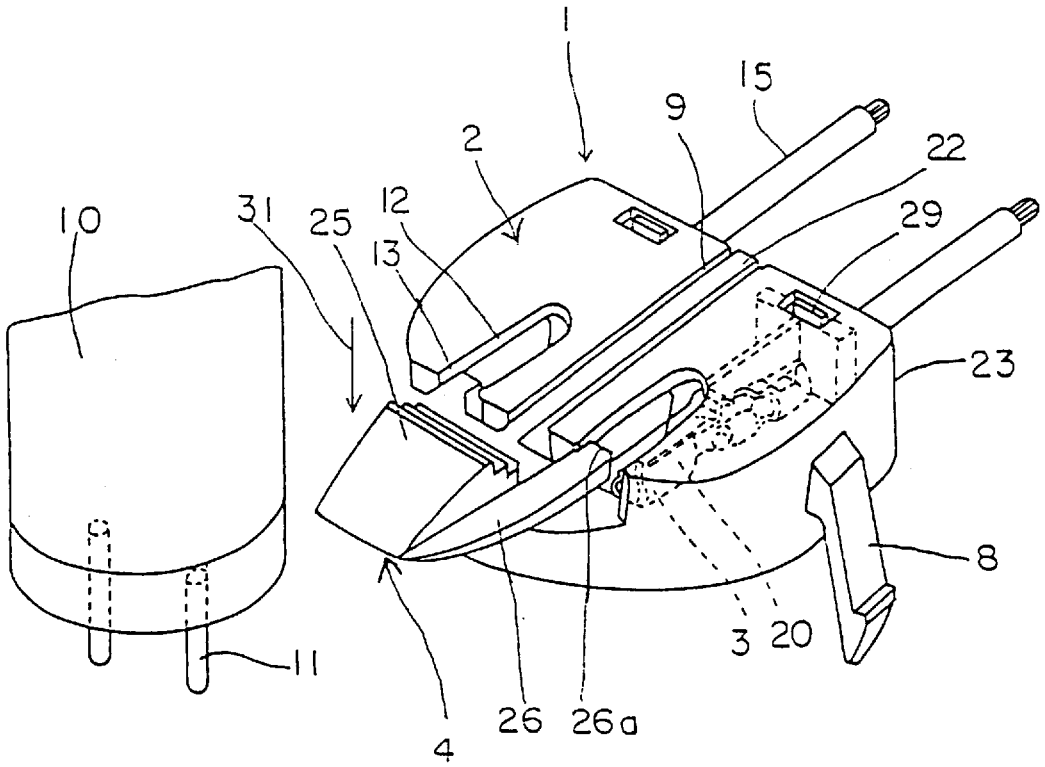
FIG. 1 is a perspective view of a fluorescent lamp socket according to a first embodiment of the invention.
Figure 2:
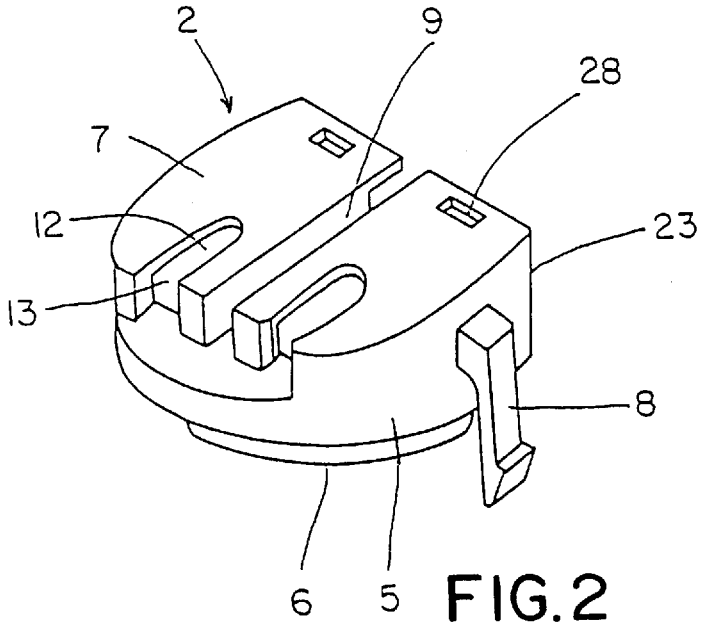
FIG. 2 is a perspective view of the socket housing, with the lever and terminals removed.

Referring to the drawings in greater detail, and first to the embodiment shown in FIGS. 1–8, a fluorescent lamp socket, generally designated 1, includes a one-piece molded plastic socket housing, generally designated 2; two stamped and formed metal terminals, generally designated 3; and a one-piece molded plastic lever, generally designated 4. Housing 2 is a shown in FIG. 2, with terminals 3 (FIG. 3) and lever 4 (FIG. 4) removed therefrom.

More particularly, socket housing 2 includes an arcuate or generally U-shaped side wall 5, a bottom wall 6 and a top wall 7. The rear of housing 2 is closed by the rear of lever 4, and it should be noted that in a typical application, the socket is mounted to a lamp housing or other fixture with its rear side facing upwardly. A pair of attaching arms 8 project from side wall 5 to attach the socket housing to the fixture. Top wall 7 of the housing has a center, longitudinal guide groove 9 and two pin slots 12 arranged on opposite sides of the guide slot. Pin slots 12 have open ends to define entrances 13 for receiving contact pins 11 (FIG. 1) projecting from the base of an elongated fluorescent lamp 10. Therefore, housing 2 and socket 1 are designed so that lamp 10 is adapted to be moved at a right angle to its axis and generally perpendicular to the axes of contact pins 11 into slots 12 of socket housing 2.

Figure 3:
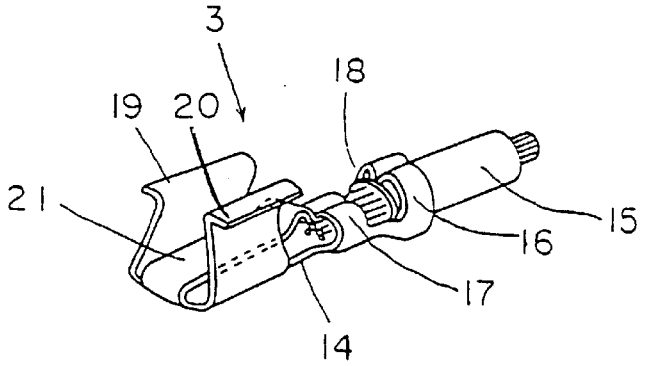
FIG. 3 is a perspective view of one of the terminals terminated to an electrical wire or cable.

Generally, a pair of terminals 3 are mounted in socket housing 2 respectively exposed in slots 12 for engagement by contact pins 11 of fluorescent lamp 10. More particularly, FIG. 3 shows one of the terminals which is of a crimping type having two pairs of crimp arms 16 and 17 at its rear end. The crimp arms are crimped and fixed onto the stripped end of an insulated electrical wire or cable 15, as at 18. Each terminal 3 has a pair of side contact portions 19 and 20 at the front end thereof for receiving a respective one of the contact pins 11 therebetween. Each terminal 3 also has a center resilient portion 21 formed back from the front end of the terminal between side contact portions 19 and 20 to form a spring means for purposes described hereinafter.

Figure 4:
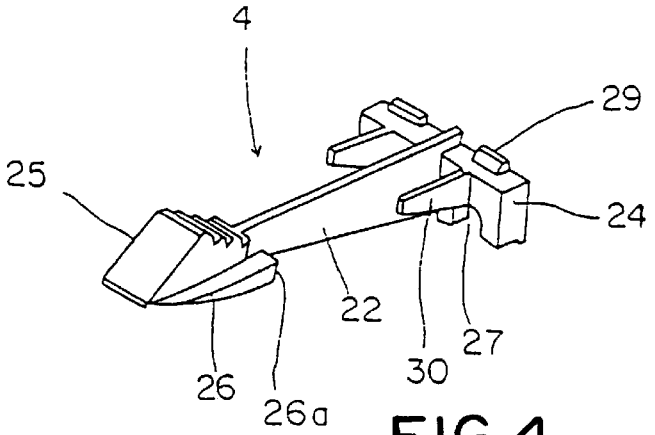
FIG. 4 is a perspective view of the lever.
Figure 5:
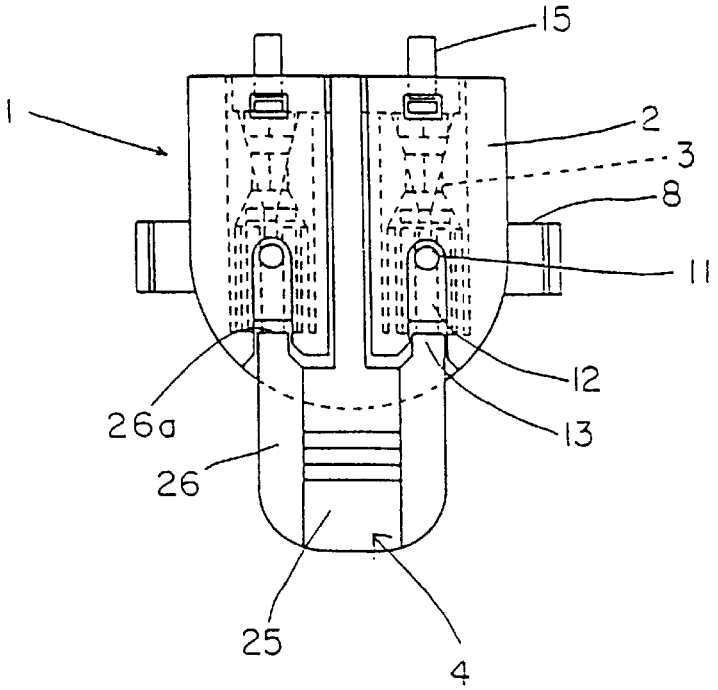
FIG. 5 is a top plan view of the socket of FIG. 1.

FIG. 4 shows lever 4 removed from socket housing 2. The lever includes a center, longitudinal guide rib 22, a pair of rectangular portions 24 integral with the guide rib on opposite sides thereof, a head portion 25 at the forward distal end of the guide rib and a pair of lateral wings 26 on opposite sides of the head portion and the longitudinal rib. The wings terminate in rearwardly facing shoulders 26*a*. Lever 4 is mounted in socket housing 2 with guide rib 22 disposed in guide groove 9 in top wall 7 between terminals 3. Rectangular portions 24 of the lever close a rear opening 23 of housing 2. Head portion 25 of the lever is enlarged to facilitate operating the lever. Each rectangular portion 24 has a notch 27 in its lower edge to permit one of the electrical wires 15 to pass therethrough. Each rectangular portion 24 also has an upwardly projecting boss 29 for snapping into openings 28 (FIG. 2) in top wall 7 of housing 2 as seen in FIG. 1. Lastly, each rectangular portion 24 has an extension 30 projecting forwardly generally parallel to center guide rib 22.

In assembly, a pair of terminals are crimped to a pair of electrical lead wires 15 and are inserted into socket housing 2 from the rear thereof so that the terminals are aligned below pins slots 12 in housing 2. Similarly, lever 4 is inserted in the housing through rear opening 23 with guide rib 22 disposed within guide groove 9 in top wall 7 of the housing until rectangular portions 24 of the lever close the rear opening of the housing. At this point, bosses 29 snap into openings 28 in the top wall of the housing and extensions 30 extend immediately beneath the top wall of the housing. Enlarged front operating head 25 of the lever projects forwardly of the housing and the lever is pivotable downwardly in the direction of arrow 31 (FIG. 1) about pivot points or fulcrums defined by bosses 29 of the lever in openings 28 in the top wall of the housing. The lever is spring-biased to a raised position by center resilient portions 21 of terminals 3 engaging the underside of extensions 30 of the lever. Actually, extensions 30 are maintained in constant contact with center resilient portions 21 of the terminals.

Figure 6:
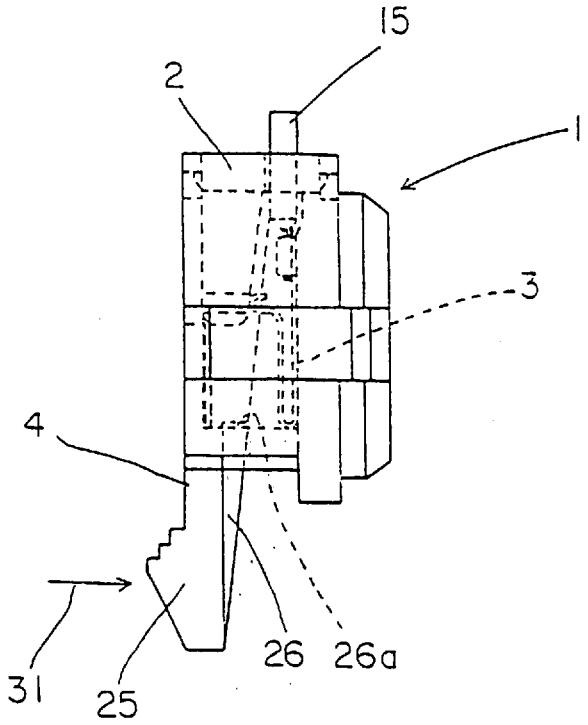
FIG. 6 is a side elevational view of the socket.
Figure 7:
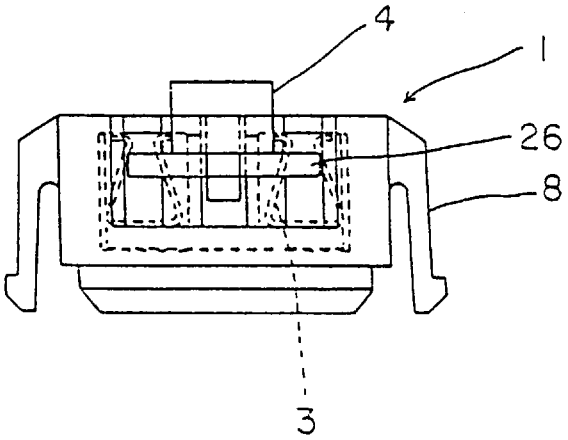
FIG. 7 is a front elevational view of the socket.
Figure 8:
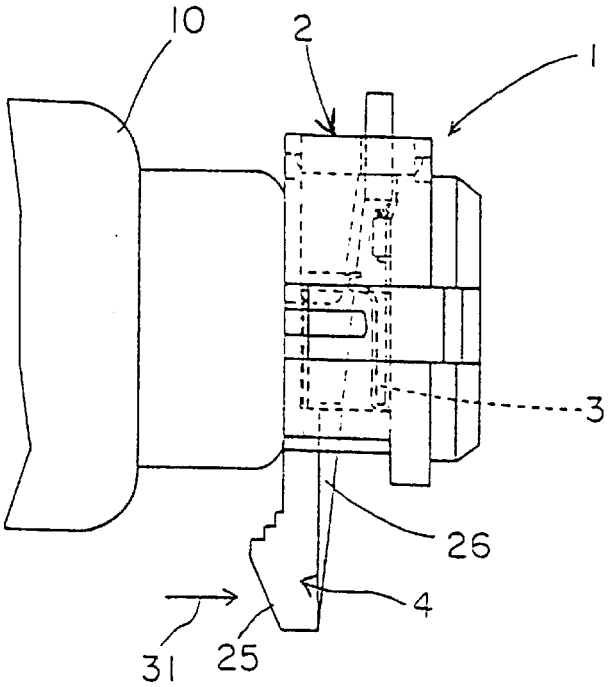
FIG. 8 is a view similar to that of FIG. 6, with the fluorescent lamp mounted on the socket.
Figure 9:
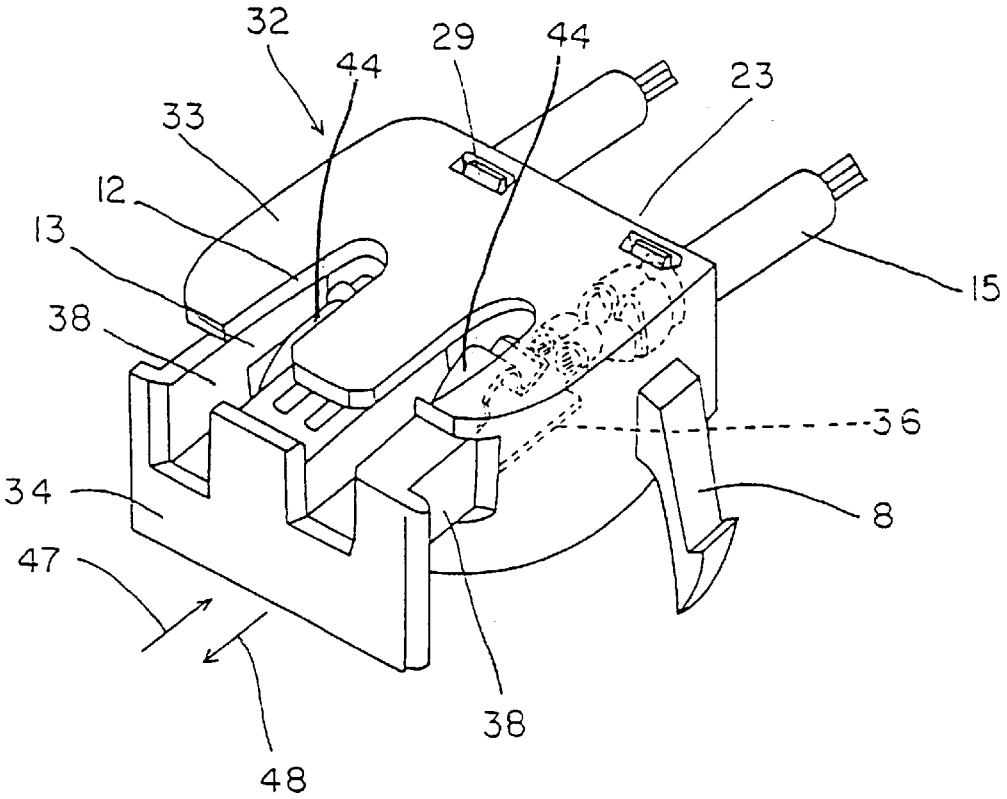
FIG. 9 is a perspective view of a fluorescent lamp socket according to a second embodiment of the invention.
Figure 10:
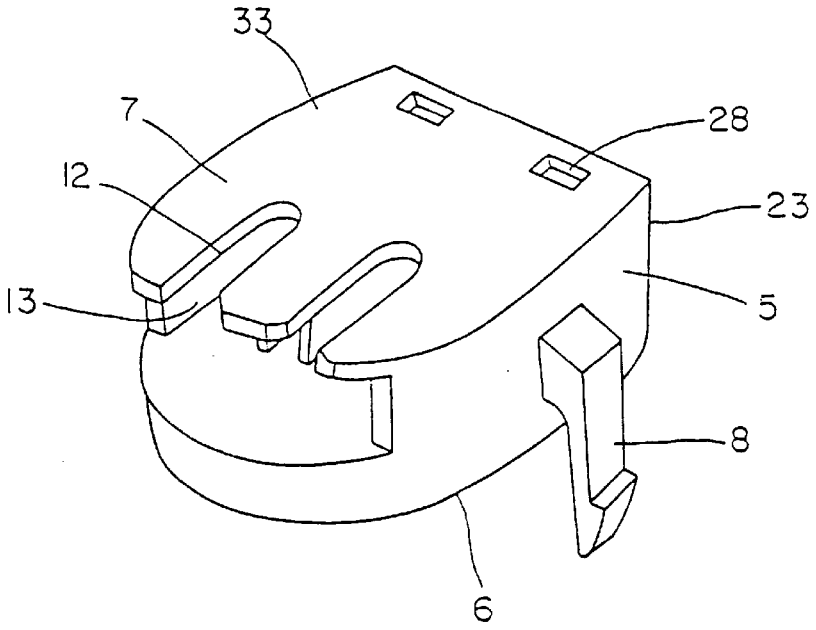
FIG. 10 is a perspective view of the socket housing of the embodiment of FIG. 9.

FIG. 8 shows fluorescent lamp 10 having been mounted in lamp socket 1. In positioning the fluorescent lamp into the socket, operating head 25 of lever 4 is pushed downwardly in the direction of arrow 31 against the biasing force of resilient portions 21 of terminals 3 so that the entrances 13 to slots 12 are open. Contact pins 11 at the base of fluorescent lamp 10 then can be moved into slots 12 and into engagement with contact portions 19 and 20 of the terminals as the contact portions sandwich the contact pins therebetween. After the fluorescent lamp is moved into the socket in a purely linear direction, operating head 25 of lever 4 is released, whereby resilient portions 21 of the terminals bias the lever back to its stress-free position as shown in FIGS. 6 and 8. In this position, shoulders 26*a* at the inner ends of wings 26 of the lever move into blocking positions within slots 12 at entrances 13 thereto and, thereby, prevent movement of contact pins 11 of lamp 10 back out of slots 12. The lamp can be removed from the socket only by again depressing lever 4 in the direction of arrow 31 to free the entrances 13 to slots 12 and allow contact pins 11 to move back out of the slots.

In summary of the action of lever 4, the lever is pivotable between a first position wherein shoulders 26*a* are removed from slots 12 to allow movement of the contact pins 11 into the slots, and a second position wherein shoulders 26*a* block slots 12 to prevent movement of contact pins 11 out of the slots. Resilient portions 21 of terminals 3 define a spring means for constantly biasing lever 4 toward its second or blocking position.

FIGS. 9–17 show a second embodiment of a fluorescent lamp socket, generally designated 32, which includes a molded plastic housing 33, a release member 34, an end cap 35 and two metal terminals 36. Housing 33 is very similar to housing 2 of the socket in the first embodiment of FIGS. 1–8 and is different primarily to the extent that it has no center, longitudinal guide groove in its top wall. Therefore, some reference numerals are used in FIGS. 9–17 corresponding to components already described in relation to FIGS. 1–8, and corresponding detailed descriptions are omitted.

Figure 11:
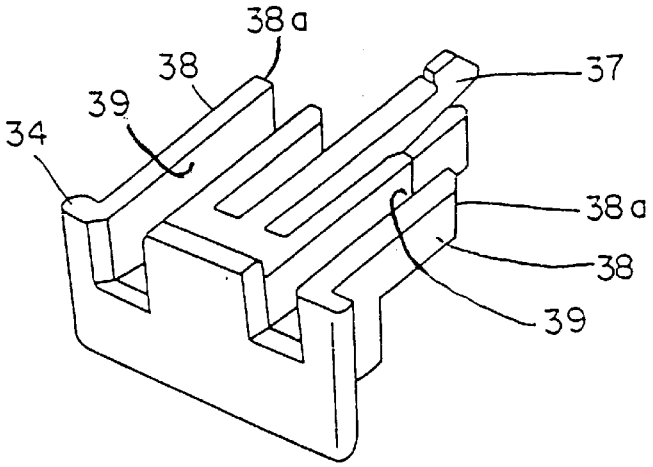
FIG. 11 is a perspective view of the release member of the socket of FIG. 9.

Release member 34 is shown best in FIG. 11 and is a unitary structure molded of plastic material. The release member is designed to be pushed in and pulled out of the notched front section of curved side wall 5 of socket housing 33. A center longitudinal latch arm 37 is adapted to engage a latch boss (not visible in the drawings) formed on the underside of top wall 7 of the housing, thereby preventing the release member from falling out of the housing. A pair of actuating arms 38 extend parallel to latch arm 37 on opposite sides thereof and terminate in distal ends or shoulders 38*a*. Grooves 39 are defined on the inside of actuating arms 38. When release member 34 is inserted into housing 33, grooves 39 in the release member align with slots 12 in the housing.

Figure 12:
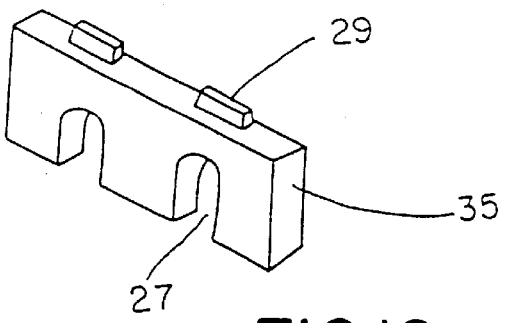
FIG. 12 is a perspective view of the end cap of the socket of FIG. 9.

End cap 35 is shown best in FIG. 12 and is sized to close the rear opening 23 of socket housing 33. Again, a pair of notches 27 are provided to accommodate electrical lead wires 15, and a pair of bosses 29 snap into the openings 28 in the top wall of the housing.

Figure 13:
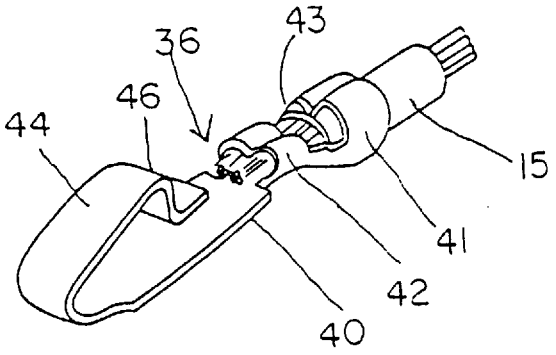
FIG. 13 is a perspective view of one of the terminals of the socket of FIG. 9.

The terminals 36 for socket 32 are best shown in FIG. 13. Again, each terminal includes a pair of crimp arms 41 and 42 for crimping onto a stripped end of the lead wire, as at 43. Each terminal has a resilient contact portion 44 bent back over a base 40 and includes a stepped distal end 46. In essence, the stepped distal end 46 defines an abutment shoulder.

In assembly of socket 32, a pair of terminals 36 again are terminated to a pair of lead wires 15 and are inserted into housing 33 from the open rear end 23 thereof so that the terminals are aligned with slots 12 in the housing. The rear opening is closed by end cap 35, and release member 34 is inserted into the housing from the front section thereof. Release member 34 is inserted to a point such that ends 38*a* of actuating arms 38 initially engage contact portions 44 of terminals 36. As seen best in FIG. 9, actuating arms 38 lie outside slots 12 to not interfere with insertion of contact pins 11 of fluorescent lamp 10 into the slots. However, contact portions 44 of terminals 36 are wider than slots 12 to permit engagement of the contact portions by actuating arms 38. Therefore, if release member 34 is pushed completely into the housing as indicated by arrow 47 in FIG. 9, distal ends 38*a* of the actuating arms will engage contact portions 44 of the terminals and bias the contact portions downwardly. Removal of release member 34 in the direction of arrow 48 will cause resilient contact portions 44 of the terminals to automatically return to their initial stress-free positions.

Figure 14:
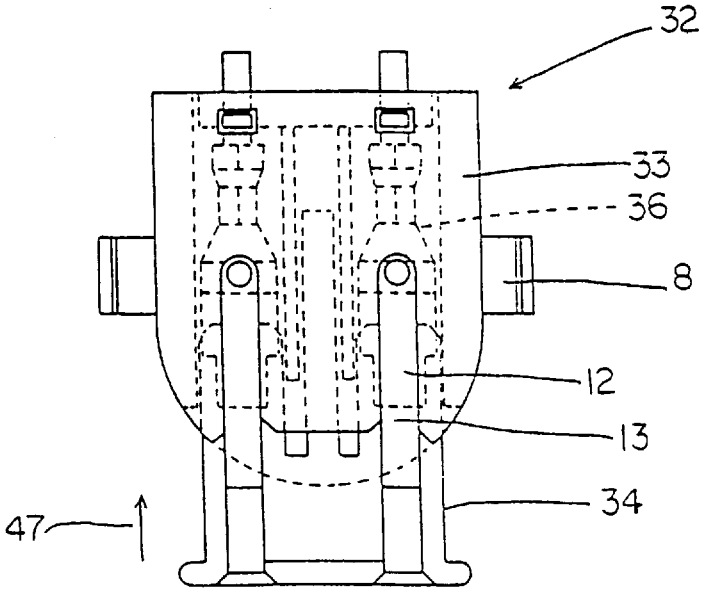
FIG. 14 is a top plan view of the socket of FIG. 9.
Figure 15:
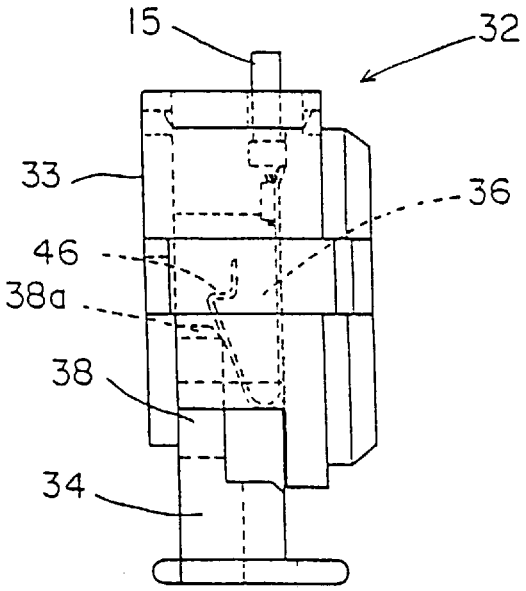
FIG. 15 is a side elevational view of the socket of FIG. 9.
Figure 16:
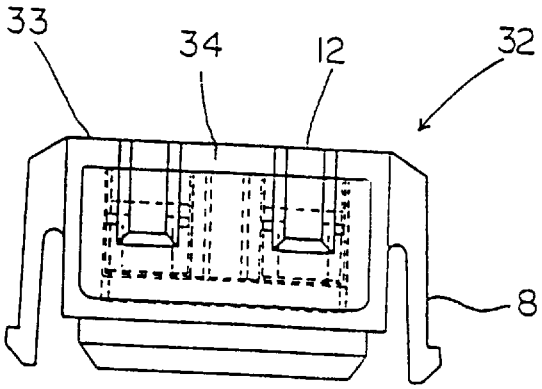
FIG. 16 is a front elevational view of the socket of FIG. 9.
Figure 17:
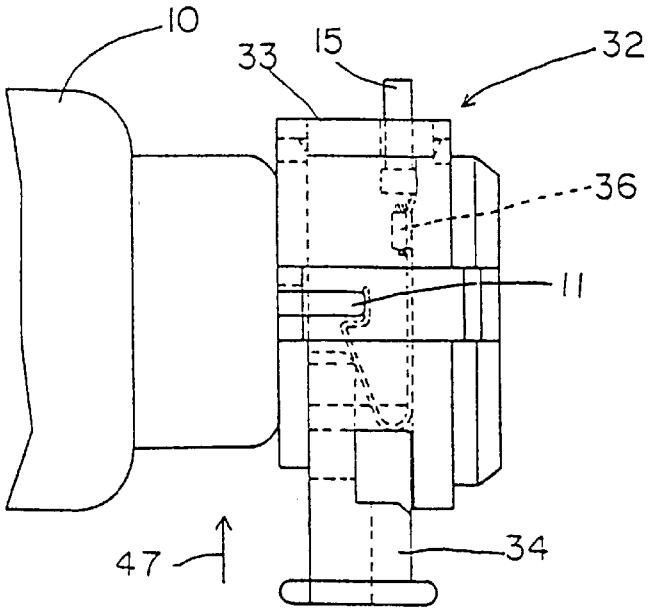
FIG. 17 is a view similar to that of FIG. 15, but showing the fluorescent lamp mounted in the socket.
Figure 18:
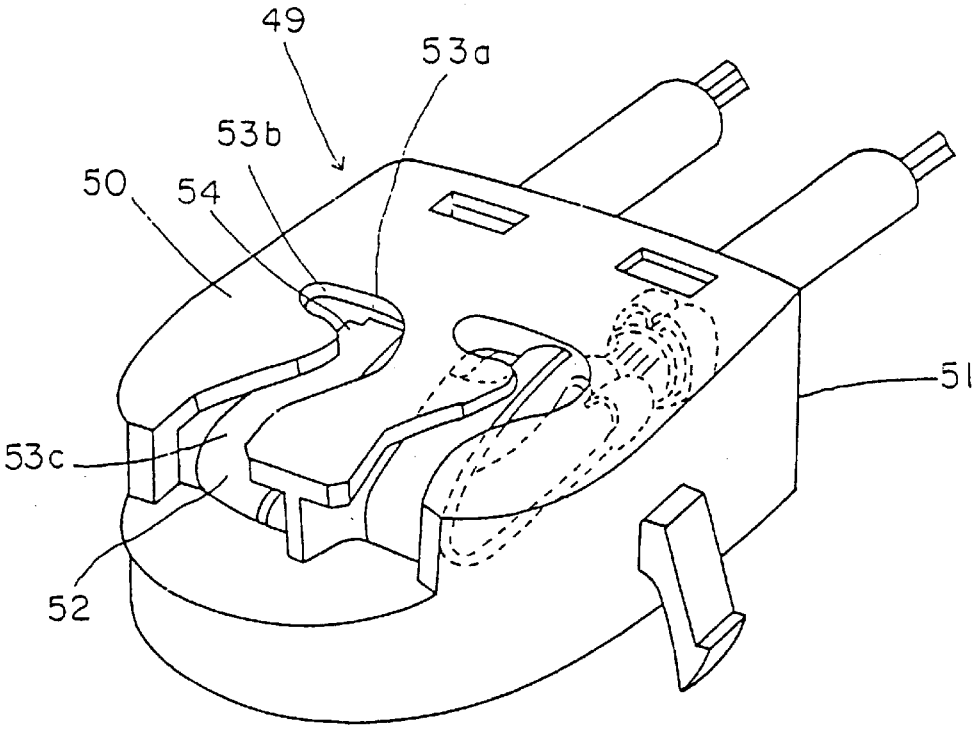
FIG. 18 is a perspective view of a fluorescent lamp socket according to a third embodiment of the invention.

FIGS. 14, 15 and 16 show the assembled fluorescent lamp socket 32, and FIG. 17 shows the socket having fluorescent lamp 10 mounted thereinto. In mounting the lamp into the socket, release member 34 is pulled out of the socket and terminal pins 11 of fluorescent lamp 10 are pushed into slots 12 in the socket housing until contact pins 11 of the lamp abut resilient contact portions 44 of terminals 36. Further movement of the contact pins into the slots cause the contact pins to engage resilient contact portions 44 of the terminals and bias the contact portions downwardly until the contact pins of the terminals move past stepped ends or shoulders 46 of the terminals. Resilient contact portions 44 of the terminals then will snap back upwardly until stepped ends or shoulders 46 block movement of the contact pins 11 back out of the housing slots, as seen in FIG. 17. In removing fluorescent lamp 10 from socket 32, release member 34 is pushed into the housing as indicated by arrow 47 in FIG. 17 until ends 38*a* of actuating arms 38 engage contact portions 44 of the terminals and move the contact portions downwardly, releasing contact pins 11 and allowing the lamp to be removed from the socket.

FIGS. 18–24 show a third embodiment of a fluorescent lamp socket, generally designated 49. This third embodiment includes a unitary molded plastic housing 50, an end cap 51 similar to end cap 35 and two metal terminals 52.

Figure 19:
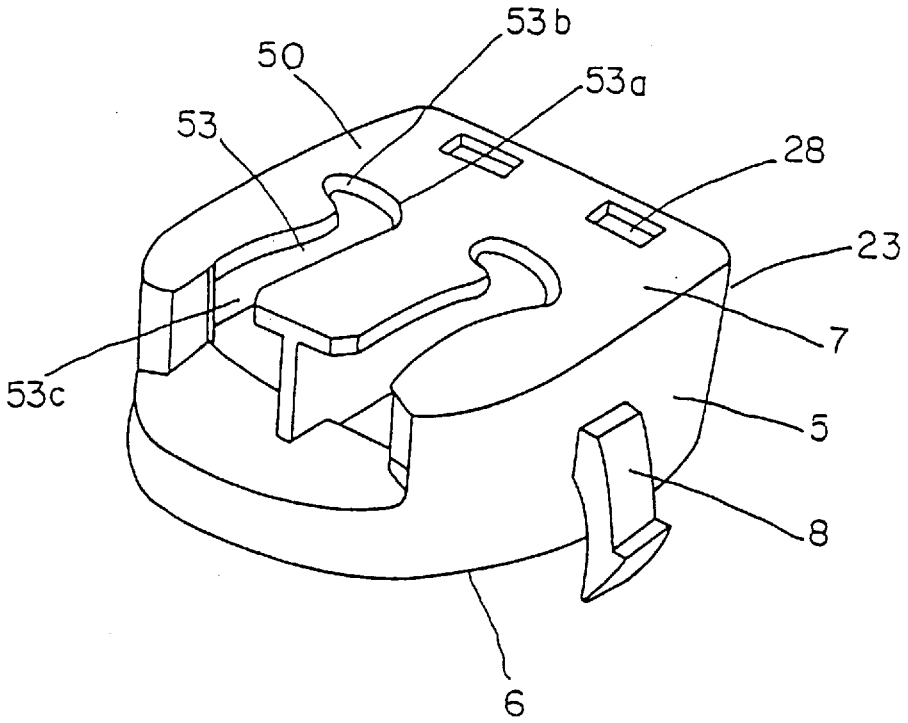
FIG. 19 is a perspective view of the housing of the socket of FIG. 18.

FIG. 19 shows housing 50 of lamp socket 49 which is different from housing 33 of the second embodiment primarily in that slots 53 of housing 50 are different in shape from slots 12 in the previous embodiments. The other parts of the third embodiment are similar to those of the second embodiment and corresponding reference numerals have been used without detailed descriptions. As seen in FIG. 19, each slot 53 terminates in a curved end 53*a*. End cap 51 has the same shape as end cap 35 of the second embodiment.

Figure 20:
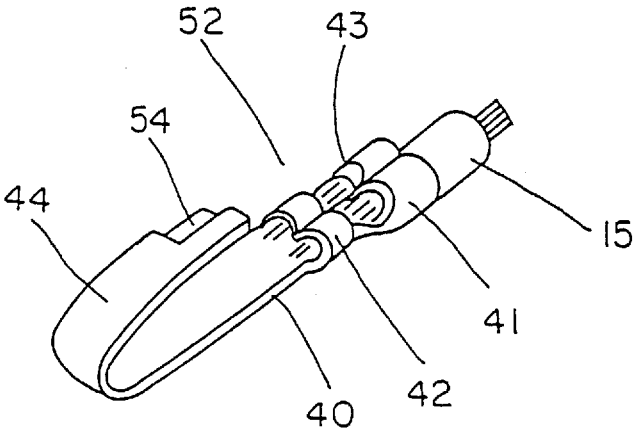
FIG. 20 is a perspective view of one of the terminals of the socket of FIG. 18.

As seen in FIG. 20, terminal 52 is substantially identical to terminal 36 of the first embodiment and corresponding reference numerals have been applied where appropriate. The primary difference is that terminal 52 has a stepped end 54 defining a shoulder which is offset to one side of resilient contact portion 44 of the terminal. In comparing FIG. 20 with FIG. 19, it can be seen that stepped ends 54 are offset to the side of the terminals in the direction of curved ends 53*a* of slots 53 in housing 50.

Figure 21:
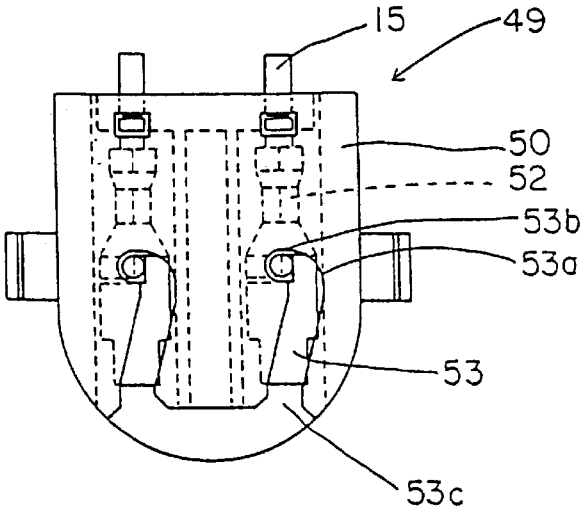
FIG. 21 is a top plan view of the socket of FIG. 18.
Figure 22:
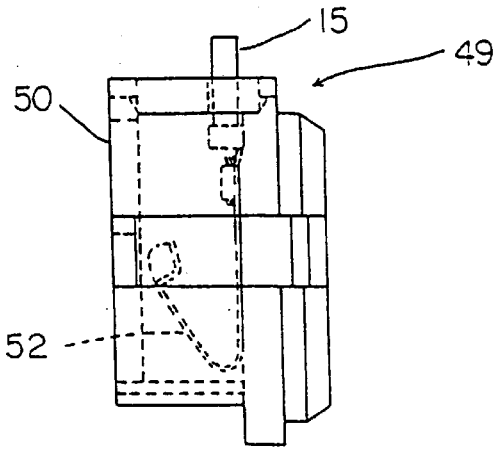
FIG. 22 is a side elevational view of the socket of FIG. 18.
Figure 23:
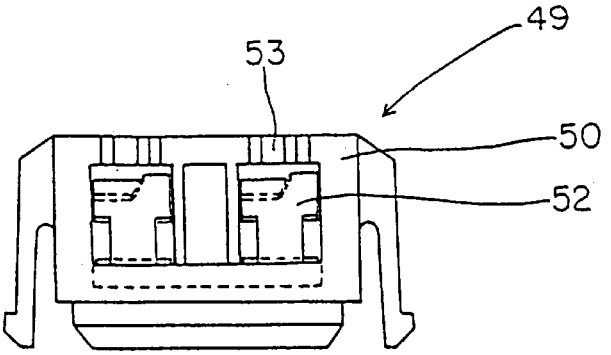
FIG. 23 is a front elevational view of the socket of FIG. 18.
Figure 24:
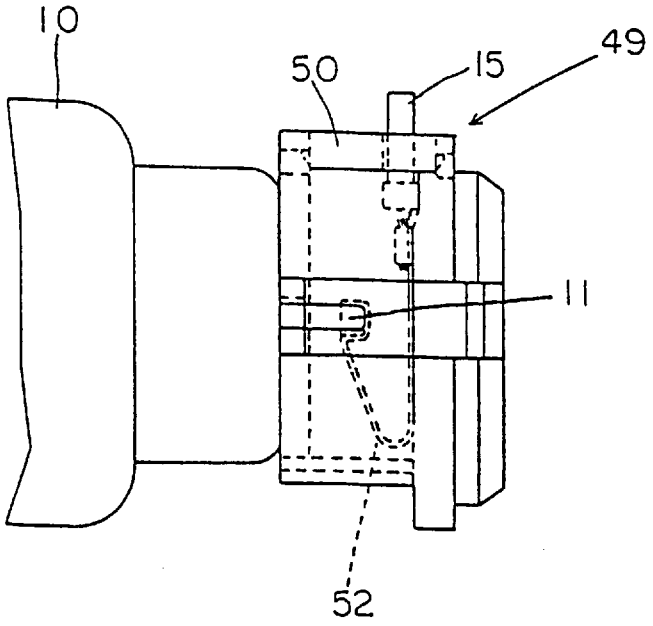
FIG. 24 is a view similar to that of FIG. 22, but showing the fluorescent lamp mounted in the socket.

FIGS. 21–23 show the assembled lamp socket 49, and FIG. 24 shows fluorescent lamp 10 and contact pins 11 mounted in the socket. The fluorescent lamp is mounted in the socket again by moving the lamp at a right angle to the axis thereof to cause contact pins 11 to enter entrances 53*c* of slots 53. The contact pins will move into curved ends 53*c* of the slots until the pins bottom out at ends 53*b* of the slots. During this movement, the tips of contact pins 11 will engage resilient contact portions 44 of terminals 52 and bias the contact portions downwardly. As the pins move into curved ends 53*a* of the slots, the pins will drop into offset stepped portions 54 of the terminals. In order to remove the fluorescent lamp from socket 49, resilient contact portions 44 of the terminals are bent downwardly so that contact pins 11 can be moved over stepped portions 54 and out of slots 53. A device similar the release lever 34 of the second embodiment can be designed for this purpose.

FIGS. 25–29 show a fourth embodiment of a fluorescent lamp socket similar to the embodiment shown in FIGS. 1–8, and some reference numerals have been applied in FIGS. 25–29 corresponding to similar components described above and shown in FIGS. 1–8 of the first embodiment. The assembly and operation of the embodiment of FIGS. 25–29 is similar to the embodiment of FIGS. 1–8 and will not be repeated.

Figure 25:
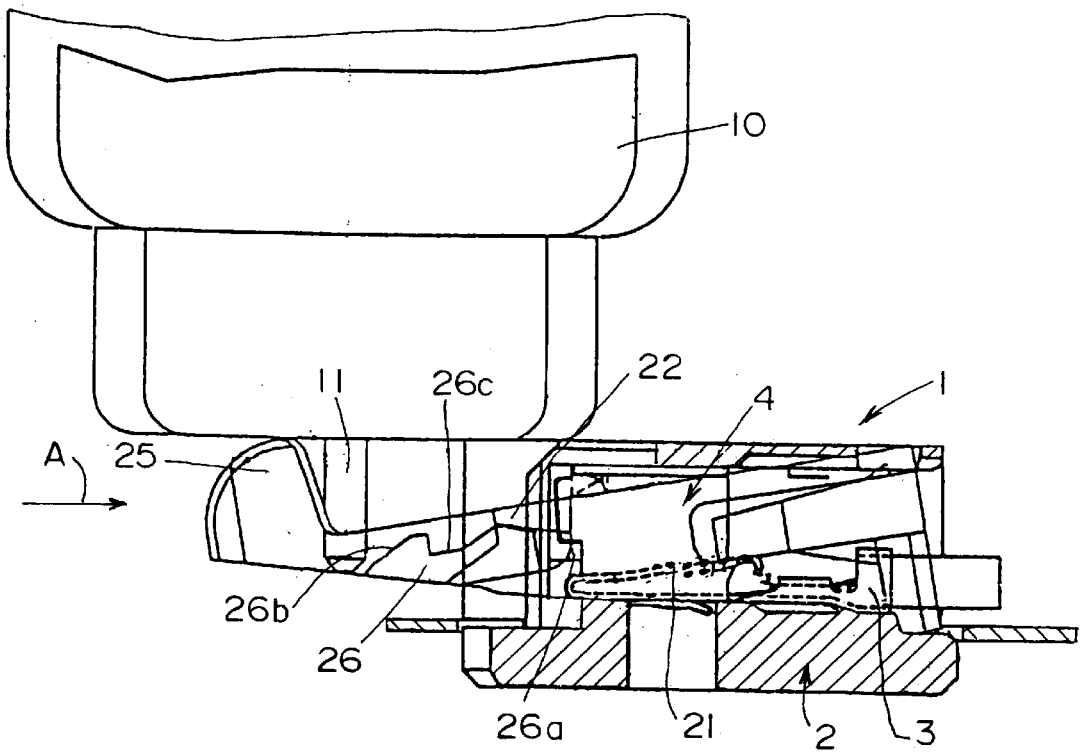
FIG. 25 is a section through a fluorescent lamp socket according to a fourth embodiment of the invention, with the lamp removed from the socket.

Suffice it to say, the embodiment of FIGS. 25–29 include a fluorescent lamp socket, generally designated 1, having a socket housing, generally designated 2, which pivotally mounts a lever, generally designated 4. A fluorescent lamp 10 includes a pair of parallel contact pins 11. Like the embodiment of FIGS. 1–8, the lamp is adapted to be moved at a right angle to its longitudinal axis into socket 1 in the direction of arrow "A" (FIG. 25). The contact pins are movable into a pair of generally parallel slots in the socket as with the embodiment of FIGS. 1–8. Lever 4 is biased upwardly toward its blocking position by a center resilient portion 21 of each terminal 3.

As with the embodiment of FIGS. 1–8, in the embodiment of FIGS. 25–29, lever 4 includes a center, longitudinal guide rib 22, a head portion 25 at the forward distal end of the guide rib and a pair of lateral wings 26 on opposite sides of the head portion and the longitudinal rib. The wings terminate in rearwardly facing shoulders 26*a*. In the embodiment of FIGS. 25–29, the front of the wings have angled surfaces 26*b* to define ramps which engage the distal ends of contact pins 11 of the fluorescent lamp. The tops of the wings are provided with receiving means in the form of notches 26*c*.

As will be seen hereinafter, ramps 26*b* at the front ends of wings 26 are engageable by contact pins 11 to automatically bias lever 4 downwardly in response to movement of the contact pins into the socket in the direction of arrow "A". Notches 26*c* are forwardly of blocking shoulders 26*a* and provide means for receiving the contact pins in a preliminary position preparatory to moving the pins fully into the socket slots. These notches provide a preliminary retention for at least one end of the fluorescent lamp while the opposite end may be manipulated, prior to fully inserting the lamp into the socket. The notches also provide a safety position should contact pins 11 inadvertently be moved out from behind blocking shoulders 26*a* of wings 26 of the lever.

FIGS. 25–29 show sequential positions of inserting fluorescent lamp 10 into socket 1. In FIG. 25, fluorescent lamp 10 is just beginning to be inserted into socket 1 at a position whereat head portion 25 of lever 4 engages the underside of the lamp, but contact pins 11 of the lamp have not yet engaged ramps 26*b* of wings 26.

Figure 26:
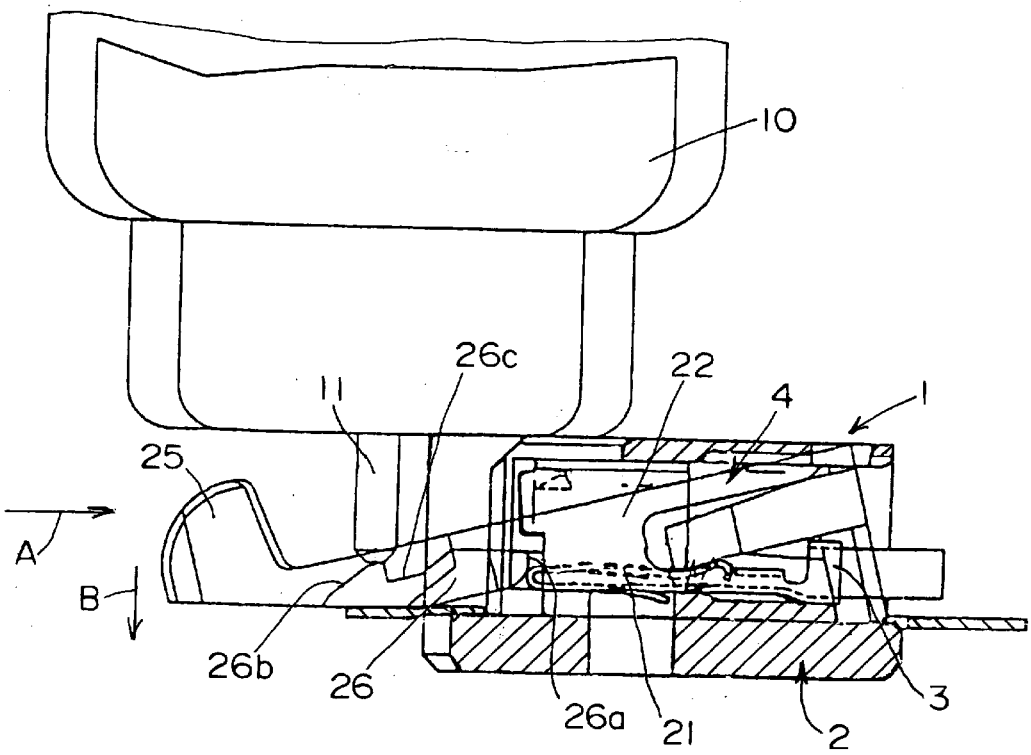
FIG. 26 is a view similar to that of FIG. 25, with the contact pins of the lamp engaging the ramps of the lever.

FIG. 26 shows fluorescent lamp 10 having been moved further in the direction of arrow "A", during which movement the distal ends of contact pins 11 engage ramps 26*b* of wings 26. During this movement, the tips of the contact pins are effective to automatically pivot the lever downwardly in the direction of arrow "B". In other words, engagement of the contact pins with ramps 26*b* automatically pivots the lever in response to movement of the contact pins into the socket.

Figure 27:
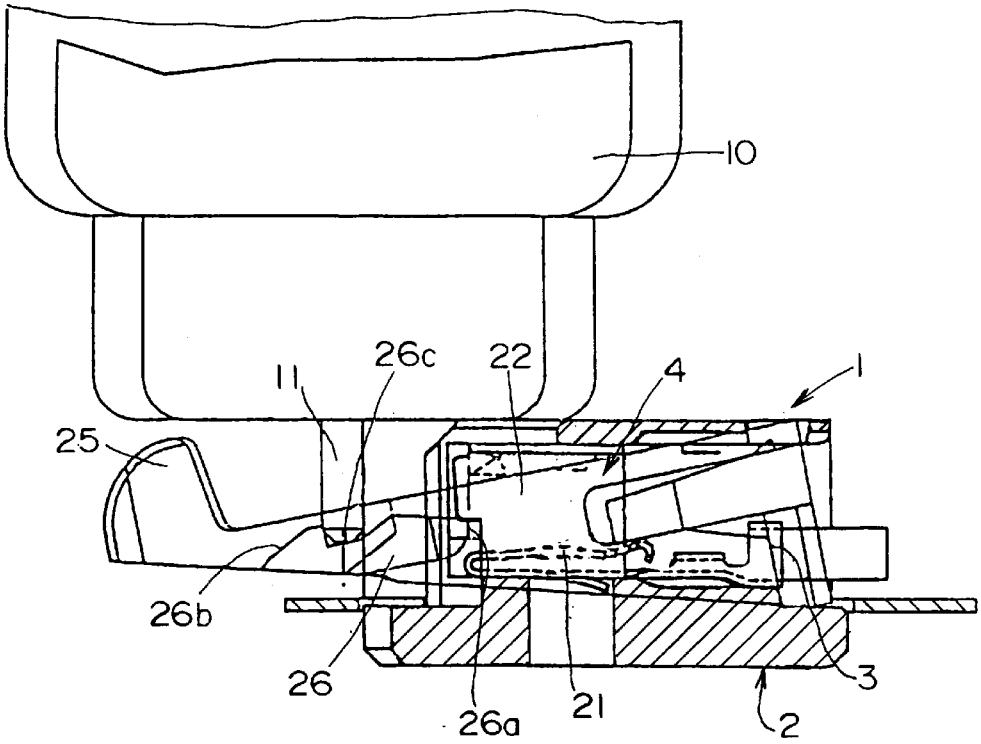
FIG. 27 is a view similar to that of FIG. 26, with the distal ends of the contact pins received in the preliminary notches of the lever.

FIG. 27 shows the distal ends of contact pins 11 having been moved into notches 26*c* of wings 26. Since resilient portions 21 of terminals 3 bias the ramp upwardly, the contact pins automatically "snap" into the notches. As stated above, the notches provide a preliminary position for the end of the fluorescent lamp preparatory to moving the lamp fully into the socket. The notches also provide a safety measure should the contact pins be moved out of engagement behind blocking shoulders 26*a* of wings 26.

Figure 28:
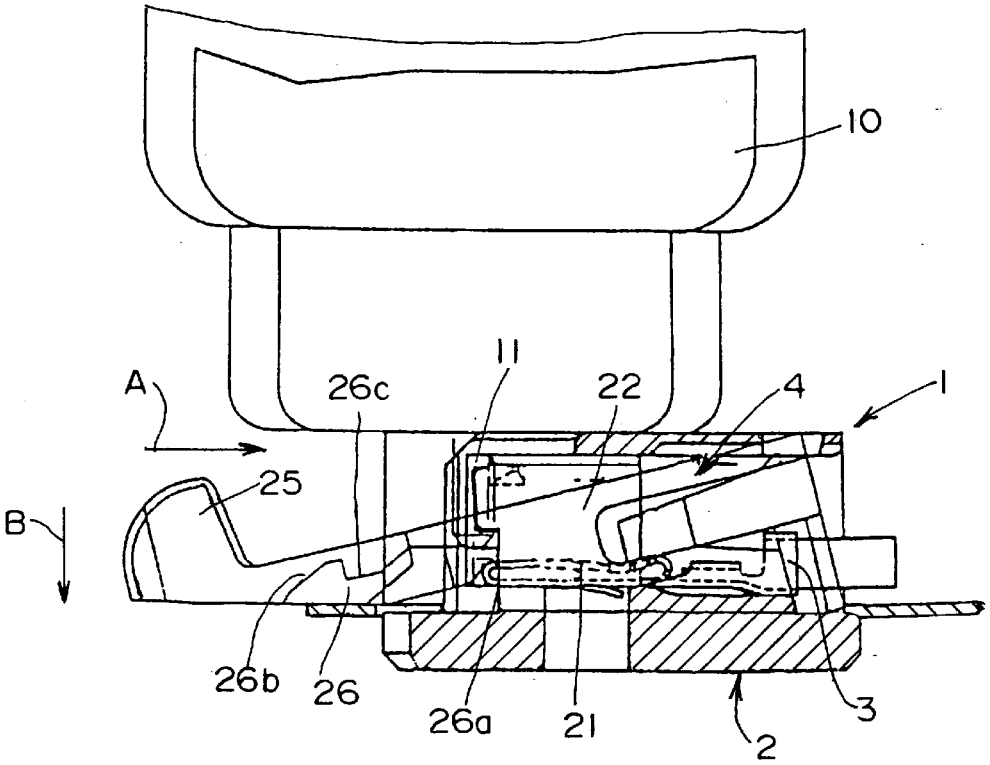
FIG. 28 is a view similar to that of FIG. 27, with the distal ends of the contact pins having been moved to the tops of the wings of the lever.

FIG. 28 shows contact pins 11 of lamp 10 having been moved further in the direction of arrow "A" out of notches 26*c* and onto the tops of wings 26. At this point, lever 4 is biased downwardly to its most extreme position to allow the contact pins to be moved fully into the slots of the socket.

Figure 29:
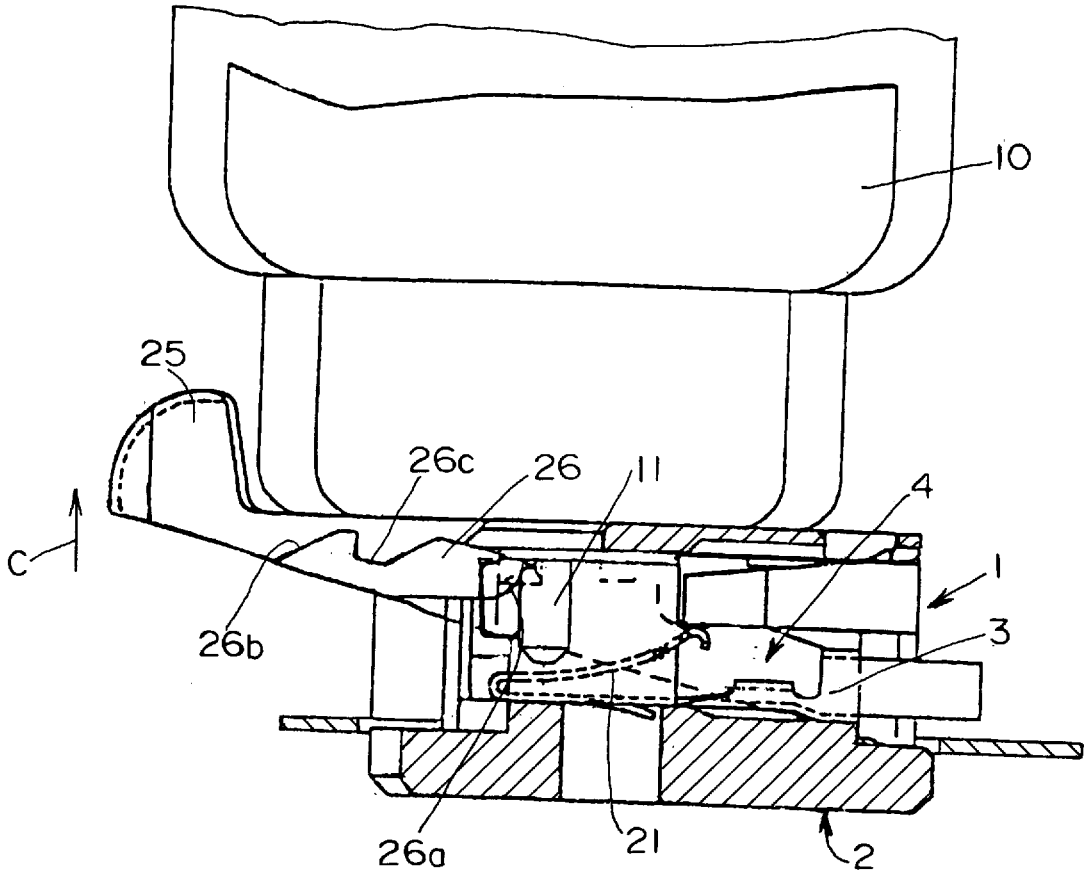
FIG. 29 is a view similar to that of FIG. 28, with the contact pins moved fully into the socket and the lever being biased upwardly for blocking removal of the contact pins out of the sockets.

Finally, FIG. 29 shows contact pins 11 having been moved fully into the socket whereat the contact pins are behind rearward blocking shoulders 26*a* of wings 26. In this position, lever 4 has been biased back upwardly in the direction of arrow "C" by resilient portions 21 of terminals 3.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A lamp socket for a fluorescent lamp of the type which has a pair of parallel contact pins extending axially from opposite ends thereof, the lamp being adapted to be moved at a right angle to its longitudinal axis into the socket, comprising:

a socket housing having a pair of generally parallel slots for receiving the contact pins as the pins are moved into the slots in a direction generally perpendicular to the axes of the pins;

a pair of terminals mounted in the socket housing respectively exposed in the slots for engagement by the contact pins;

a lever pivotally mounted in the socket housing and including blocking portions aligned with said slots, the lever being pivotable between a first position wherein said blocking portions are removed from the slots to allow movement of the contact pins into the slots and a second position wherein said blocking portions block the slots to prevent movement of the contact pins out of the slots; and spring means for biasing the lever toward said second position.

2. The lamp socket of claim 1 wherein said spring means comprise a resilient portion of at least one of said terminals.

3. The lamp socket of claim 1 wherein said lever includes a guide rib movable within a guide groove in the socket housing centrally between said slots.

4. The lamp socket of claim 3 wherein said blocking portions are located on opposite sides of said guide rib.

5. The lamp socket of claim 1 wherein said lever includes a pair of wings which terminate in a pair of shoulders defining said blocking portions of the lever.

6. The lamp socket of claim 5 wherein said wings comprise ramps engageable by the contact pins to automatically bias the lever to its first position in response to movement of the contact pins into the slots.

7. The lamp socket of claim 5 wherein said wings include notches forwardly of said blocking portions for receiving the contact pins in a preliminary position preparatory to moving the pins fully into the slots.

8. The lamp socket of claim 7 wherein said wings comprise ramps engageable by the contact pins to automatically bias the lever to its first position in response to movement of the contact pins into the slots.

9. The lamp socket of claim 1 wherein said lever includes receiving means for receiving the contact pins in a preliminary position preparatory to moving the pins fully into the slots.

10. The lamp socket of claim 9 wherein said receiving means comprise notches forwardly of said blocking portions for receiving distal ends of the contact pins.

11. The lamp socket of claim 1 wherein each of said terminals include side portions on opposite sides of a respective one of said slots for engaging a respective one of the contact pins and a central resilient portion between the side portions comprising said spring means.

12. A lamp socket for a fluorescent lamp of the type which has a pair of parallel contact pins extending axially from opposite ends thereof, the lamp being adapted to be moved at a right angle to longitudinal axes of said pins into the socket, comprising:

a socket housing having a guide groove centrally located between a pair of generally parallel slots for receiving the contact pins as the pins are moved into the slots in a direction generally perpendicular to the axes of the pins;

a pair of terminals mounted in the socket housing respectively exposed in the slots for engagement by the contact pins;

a one-piece lever pivotally mounted in the socket housing and including a guide rib movable within said guide groove, a pair of wings on opposite sides of the guide rib with the wings terminating in a pair of shoulders defining blocking portions aligned with the slots, the lever being pivotable between a first position wherein said blocking portions are removed from the slots to allow movement of the contact pins into the slots and a second position wherein said blocking portions block the slots to prevent movement of the contact pins out of the slots; and spring means for biasing the lever toward said second position.

13. The lamp socket of claim 12 wherein said spring means comprise a resilient portion of at least one of said terminals.

14. The lamp socket of claim 13 wherein each of said terminals include side portions on opposite sides of a respective one of said slots for engaging a respective one of the contact pins and a central resilient portion between the side portions comprising said spring means.

15. The lamp socket of claim 12 wherein said wings comprise ramps engageable by the contact pins to automatically bias the lever to its first position in response to movement of the contact pins into the slots.

16. The lamp socket of claim 12 wherein said wings include notches forwardly of said blocking portions for receiving the contact pins in a preliminary position preparatory to moving the pins fully into the slots.

17. The lamp socket of claim 16 wherein said wings comprise ramps engageable by the contact pins to automatically bias the lever to its first position in response to movement of the contact pins into the slots.

18. The lamp socket of claim 12 wherein said lever includes receiving means for receiving the contact pins in a preliminary position preparatory to moving the pins fully into the slots.

19. The lamp socket of claim 18 wherein said receiving means comprise notches forwardly of said blocking portions for receiving distal ends of the contact pins.

20. A lamp socket for a fluorescent lamp of the type which has a pair of parallel contact pins extending axially from opposite ends thereof, the lamp being adapted to be moved at a right angle to longitudinal axes of said pins into the socket, comprising:

a socket housing having a pair of generally parallel slots for receiving the contact pins as the pins are moved into the slots in a direction generally perpendicular to the axes of the pins;

a pair of terminals mounted in the socket housing respectively exposed in the slots for engagement by the contact pins;

a lever pivotally mounted in the socket housing and including at least one blocking portion, the lever being pivotable between a first position wherein said blocking portion allows movement of the lamp and contact pins into the socket and a second position wherein the blocking portion blocks movement of the lamp and pins into the socket, the lever including receiving means for receiving the contact pins in a preliminary position preparatory to moving the pins fully into the socket; and spring means for biasing the lever toward said second position.

21. The lamp socket of claim 20 wherein said receiving means comprise notches forwardly of said blocking portion for receiving distal ends of the contact pins.

* * * * *